US011330357B2

(12) United States Patent
Deng

(10) Patent No.: US 11,330,357 B2
(45) Date of Patent: May 10, 2022

(54) FLAT HEADSET

(71) Applicant: SHENZHEN XIWXI TECHNOLOGY CO., LTD., Shenzhen (CN)

(72) Inventor: Xiuhong Deng, Shenzhen (CN)

(73) Assignee: SHENZHEN XIWXI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/136,194

(22) Filed: Dec. 29, 2020

(65) Prior Publication Data

US 2022/0103929 A1 Mar. 31, 2022

(30) Foreign Application Priority Data

Sep. 30, 2020 (CN) ..... 202022222868.X

(51) Int. Cl.
*H04R 5/02* (2006.01)
*H04R 1/10* (2006.01)

(52) U.S. Cl.
CPC ..... *H04R 1/1066* (2013.01)

(58) Field of Classification Search
CPC ..... H04R 1/1008; H04R 1/1075; H04R 2201/107; H04R 5/0335; H04R 2201/103; H04R 1/1033; H04R 1/1041; H04R 1/1066; H04R 1/1058
See application file for complete search history.

(56) References Cited

U.S. PATENT DOCUMENTS

| | | | | |
|---|---|---|---|---|
| 7,058,989 | B2 * | 6/2006 | Domingos | A42B 3/00 2/412 |
| 8,542,859 | B2 * | 9/2013 | Alden | H04R 5/023 381/376 |
| D845,271 | S * | 4/2019 | Lu | D14/205 |
| 10,568,371 | B1 * | 2/2020 | Murrer | A41D 20/00 |

* cited by examiner

*Primary Examiner* — Amir H Etesam
(74) *Attorney, Agent, or Firm* — Li & Cai Intellectual Property (USA) Office

(57) ABSTRACT

A flat headset is provided, comprising: a flexible belt body (1) configured to be looped around a head, and two headset bodies (4) fixed to the flexible belt body (1). The headset bodies (4) have flat structure, and at least parts of the headset bodies (4) protrude from one edge of the flexible belt body (1), and are provided with sound output holes (2) on a side away from the flexible belt body (1). When the flexible belt body (1) is fixed to the head, the two headset bodies (4) are held on front upper sides of two ears, and the sound output holes (2) are close to ear canals. The flat headset of the present disclosure does not compress the ear canals and ears, is more comfortable to use, and can prevent the headsets from falling off due to vibration and sweat during exercise.

10 Claims, 4 Drawing Sheets

FLAT HEADSET

FIELD OF THE DISCLOSURE

The present disclosure relates to the field of headset, in particular, to a flat headset.

BACKGROUND OF THE DISCLOSURE

Headsets are usually divided into in-ear and non-in-ear. In-ear headsets should be inserted into the ear canal when in use, which not only causes discomfort due to pressure on the ear canal, but also causes great hearing damage, and is easy to fall off and is not suitable for sports use. Non-in-ear headsets usually use a C-shaped bracket to clamp the two headset bodies on the ears. The clamping force exerted by the bracket presses the ears, causing discomfort when worn for a long time, and it is easy to fall off during exercise.

In view of this, it is necessary to develop a headset that does not fall off during exercise, does not compress the ears and ear canals, and can be applied to different head types.

SUMMARY OF THE DISCLOSURE

The purpose of present disclosure is to provide a flat headset which will not fall off during exercise and does not compress the ears and ear canals.

In order to achieve the above purpose, the technical solutions adopted by the present disclosure are as follows.

A flat headset is provided, comprising: a flexible belt body configured to be looped around a head; and two headset bodies fixed to the flexible belt body; wherein, the headset bodies have flat structure, and at least parts of the headset bodies protrude from one edge of the flexible belt body, and are provided with sound output holes on a side away from the flexible belt body; and wherein when the flexible belt body is fixed to the head, the two headset bodies are held on front upper sides of two ears, and sound output holes are close to ear canals.

Preferably, the flexible belt body is a silicone belt body, a rubber belt body, a polyurethane (PU) belt body, and a thermoplastic elastomer (TPE) belt body. The rubber belt is more preferably a thermoplastic Rubber (TPR) belt. The polyurethane belt is more preferably a thermoplastic polyurethane (TPU) belt.

Preferably, the flexible belt body comprises a connecting buckle with adjustable elasticity.

Preferably, the flexible belt body is composed of three sections, a hole array is provided on an end of each section, a needle array corresponding to the hole array is provided on the headset body, the hole array and the corresponding needle array are configured to integrate the headset bodies and the three sections of the flexible belt body into one piece.

Preferably, a connecting groove is provided on the end of each section, and an edge of the headset body is snap-fitted with the connecting groove.

Preferably, a glue layer is provided on a surface of the headset bodies which is in contact with human body.

Preferably, a receiving cavity corresponding to a microphone on a circuit board is provided inside the headset body, a sound input hole communicating with the receiving cavity is provided on the protruding part of the headset body, and a sealing pad is provided between a mouth of the receiving cavity and the circuit board.

Preferably, a light exit hole corresponding to an indicator light on the circuit board is provided on a face shell of the headset body, and a sealing pad is further arranged between a periphery of the indicator light and the face shell.

Preferably, the flat headset further comprises a wireless connection module, for example Bluetooth module, and a battery, wherein the Bluetooth module is installed in one of the headset bodies, and the battery is installed in the other one of the headset bodies.

Preferably, the face and back of the headset body are both long strips and edges of the face and the back adopt arc transition.

Compared with the prior art, the present disclosure has at least the following beneficial effects.

The headset is fixed to the head with a flexible belt body, which is reliable to wear and will not fall off.

The headset bodies adopt flat structure, so that when worn on the head by a flexible belt body, the headset body can be kept on the upper front side of the ear, and sound output holes are close to ear canals, so that the ear canals and ears are not pressed, and the use is more comfortable.

The flexible belt body is made of silicone belt body or rubber belt body. When the surface of the headset bodies contacting the human body is provided with a glue layer, it has the function of anti-skid and waterproof, which can more effectively prevent the headset from falling off due to vibration and sweat during exercise.

The multi-section belt body is used to embody the connection between the headset body and the belt body through the cooperation of the hole array and the needle array, which has the characteristics of convenient production and favorable miniaturization of the headset body.

The special microphone installation structure can effectively prevent water from entering the headset body from the sound output holes.

The installation of the Bluetooth module and the battery into the two headset bodies facilitates miniaturization of the headset body.

REFERENCE NUMERAL

1. flexible belt body; 2. sound output holes; 3. adhesive layer; 4. headset body; 5. charging interface; 6. buckle hole; 7. buckle nail; 8. section; 9. face shell; 10. first rubber pad; 11. indicator light; 12. circuit board; 13. speaker; 14. back shell; 15. sound input hole; 16. receiving cavity; 17. second rubber pad; 18. microphone; 19. hole array; 20. connecting groove; 21. needle array; 22. edge.

DETAILED DESCRIPTION OF THE EXEMPLARY EMBODIMENTS

The present disclosure will be further explained below in conjunction with the drawings and embodiments.

Figure 1:
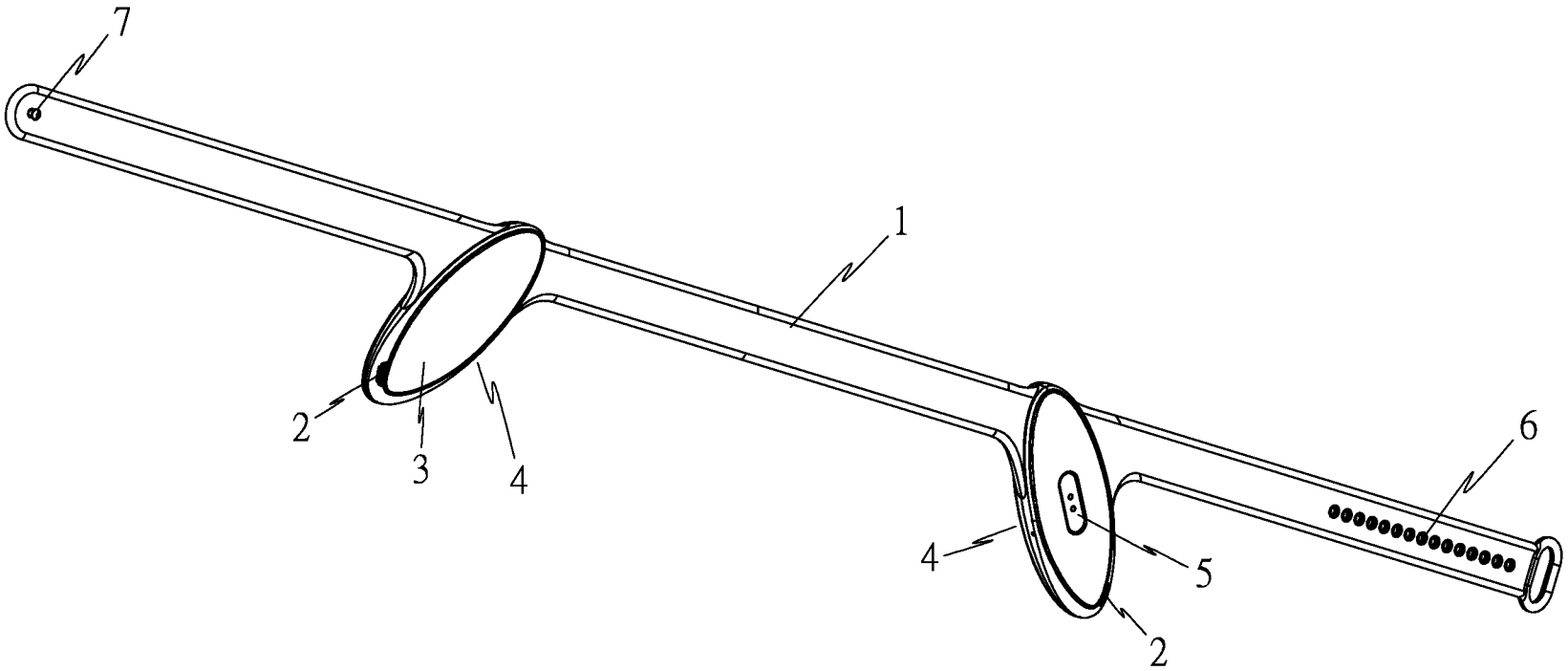
FIG. 1 is a schematic structural diagram of a headset according to an embodiment.

Reference is made to FIG. 1. The flat headset includes: a flexible belt body 1 configured to be looped around a head, and two headset bodies 4 fixed to the flexible belt body 1.

The flexible belt body 1 preferably has an elastic belt body so as to reliably fix the headset on the user's head while reducing the pressure on the head. The flexible belt body 1 is preferably a silicone belt body, a rubber belt body, a polyurethane (PU) belt body or a thermoplastic elastomer (TPE) belt body to further have the characteristics of anti-slip, waterproof and durable. When a rubber belt is used for the flexible belt 1, a thermoplastic rubber (TPR) belt is more preferable. When the flexible belt 1 adopts a polyurethane belt, it is more preferably a thermoplastic polyurethane (TPU) belt. A plurality of buckle holes 6 are provided at one end of the flexible belt body 1, a buckle nail 7 is provided at the other end of the flexible belt body 1, and they constitute a connecting buckle with adjustable elasticity. The buckle nail 7 cooperates with the buckle hole 6 to fix the flexible belt 1 on the user's head. The buckle nail 7 is matched with different buckle holes 6, and the tightness can be adjusted to suit different users.

As shown in FIG. 1, the headset bodies 4 have flat structure, and parts of the headset bodies 4 protrude from one edge of the flexible belt body 1, and are provided with sound output holes 2 on a side away from the flexible belt body 1. When the flexible belt body 1 is fixed to the head, the two headset bodies 4 are held on upper front sides of two ears, and sound output holes 2 are close to ear canals. Furthermore, an adhesive layer 3 is further provided on the surface of the headset body 4 that is in contact with human body, that is, the surface of the back shell 14. On the one hand, the adhesive layer 3 makes the user feel soft and comfortable, and on the other hand, it plays a role of anti-skid and waterproof, preventing the headset from falling off due to sweat and vibration during exercise.

Reference is made to FIG. 1, FIG. 2, FIG. 4 and FIG. 5. The flexible belt body 1 is composed of three sections 8, the end of each section 8 is provided with a hole array 19, the headset body 4 where corresponds to the hole array 19 is provided with a needle array 21, and the hole array 19 and the corresponding needle array 21 cooperate to integrate the headset bodies 4 and the three sections 8 of the flexible belt body 1 into one piece. Through the above-mentioned combined belt body structure and the connection structure between the belt body and the headset body 4, the assembly of the belt body and the headset body 4 is convenient, and the connection part occupies a small space, thereby facilitating the miniaturization of the headset body 4.

Figure 4:
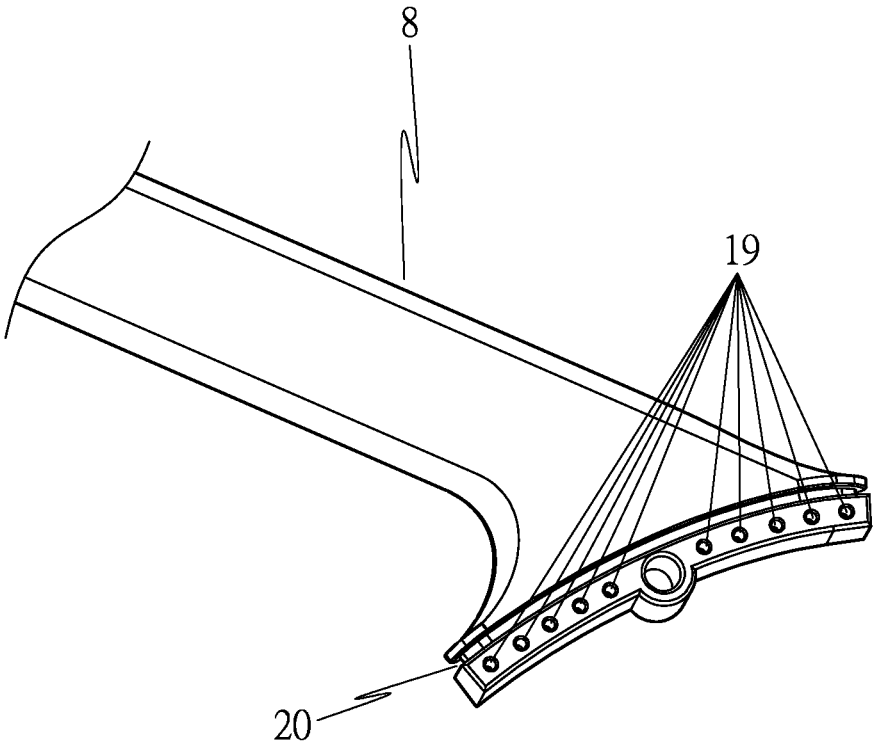
FIG. 4 is a schematic diagram of the hole array and the connecting groove on section of the belt body.
Figure 5:
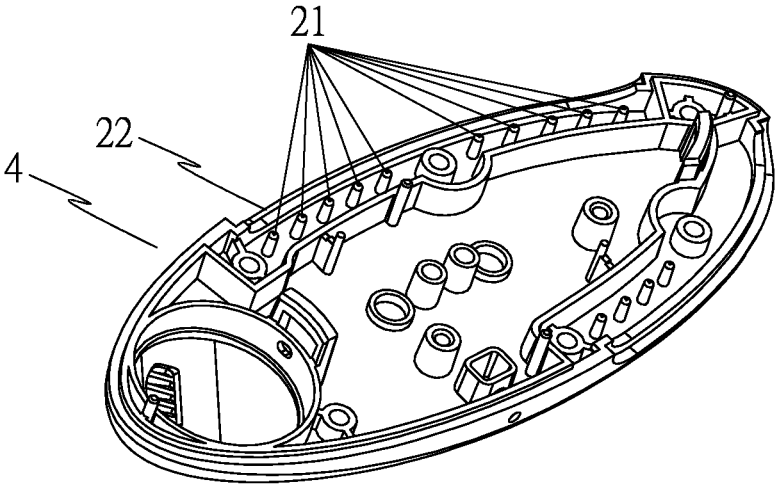
FIG. 5 is a schematic diagram of the needle array in the headset body.

Reference is made to FIG. 4 and FIG. 5. The end of the section 8 is further provided with a connecting groove 20. After the section 8 and the headset body 4 are combined, the edge 22 of the headset body 4 is snap-fitted with the connecting groove 20. The snap-fit structure, on the one hand, strengthens the connection between the section 8 and the headset body 4, and on the other hand, it can prevent water from entering the interior of the headset body 4 from the connecting portion of the section 8 and the headset body 4.

Figure 2:
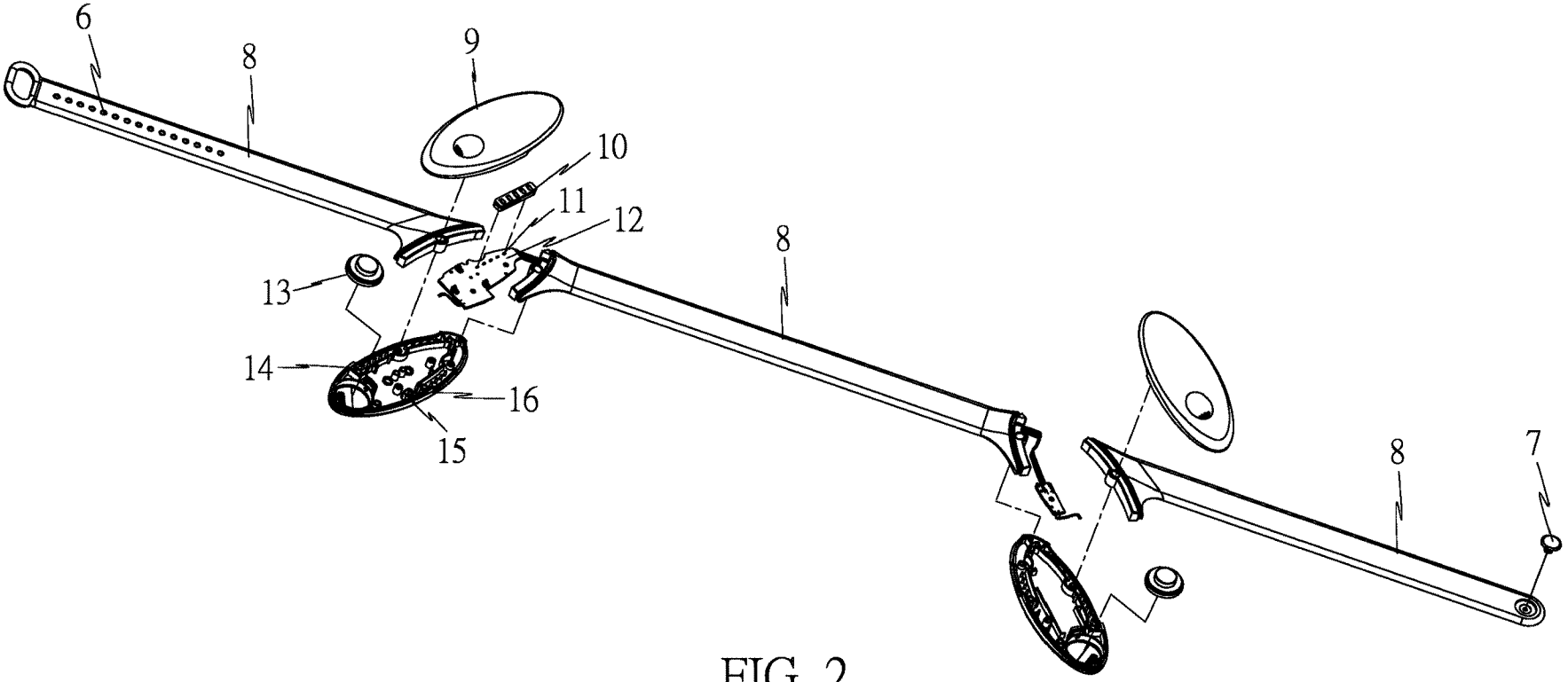
FIG. 2 is an exploded view according to FIG. 1.
Figure 3:
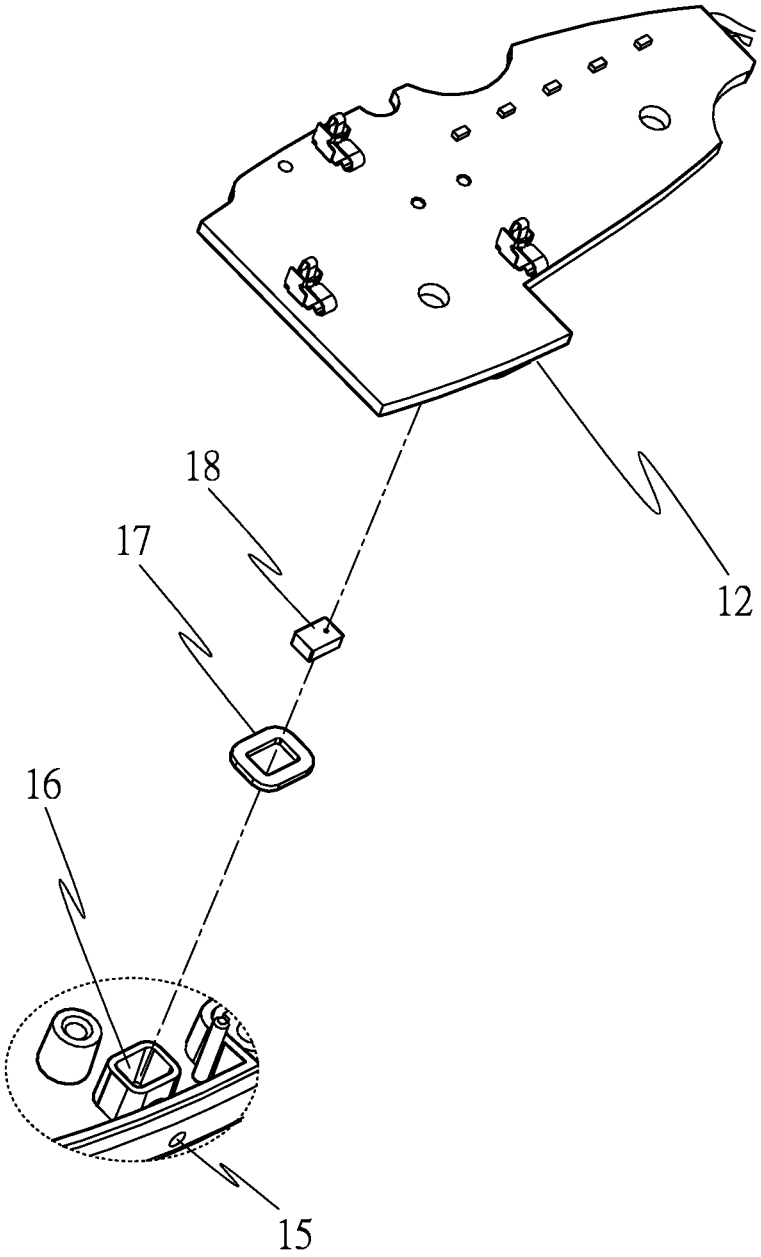
FIG. 3 is a schematic diagram of the installation structure of the microphone.

Reference is made to FIG. 2 and FIG. 3. The interior of the headset body 4 where corresponds to the microphone 18 on the circuit board 12 is provided with a receiving cavity 16, a sound input hole 15 communicating with the receiving cavity 16 is provided on the protruding part of the headset body 4, and a second rubber pad 17 (i.e., a sealing pad) is provided between a mouth of the receiving cavity 16 and the circuit board 12. The aforementioned receiving cavity 16 and the second rubber pad 17 constitute a water-proof structure, so that sound can be collected by the microphone 18 from the sound input hole 15 while water is blocked by the receiving cavity 16 and the second rubber pad 17 and cannot enter headset body 4 from the sound input hole 15.

Reference is made to FIG. 2. The circuit board 12 is also provided with an indicator light 11, and the face shell 9 of the headset body 4 is provided with a light exit hole (not shown) corresponding to the indicator light 11 on the circuit board 12. A first rubber pad 10 (i.e., a sealing pad) is also provided around the indicator light 11 and between the face shell 9 to prevent water from entering the circuit board 12 from the light exit hole.

Further, the flat headset is a Bluetooth headset, and the flat headset further includes a wireless connection module, for example a Bluetooth module, and a battery. The Bluetooth module is installed in one of the headset bodies 4, and the battery is installed in the other one of the headset bodies 4. The installation of the battery and the Bluetooth module in the two headset bodies 4 can further make the headset body 4 smaller. The back shell 14 of the headset body 4 is also provided with a magnetic charging interface 5 (referring to FIG. 1), which can charge the battery.

In this embodiment, a face and a back of the headset bodies 4 are both oval, which not only allows the headset body 4 to be located on the upper front side of the ear and the sound output holes 2 close to the ear canals, but also has the characteristics of being beautiful and compact. In addition, a face and a back of the headset bodies 4 are preferably elongated, and edges of the face and the back adopt arc transition.

The above-mentioned flat headset has at least the following advantages. 1. It is fixed to the head with a flexible belt body 1, which is reliable to wear and will not fall off, and is very suitable for use during exercise. 2. The headset bodies 4 adopt flat structure, so that when the headset body 4 is worn on the head through the flexible belt body 1, the headset body 4 is kept on the upper front side of the ear, and the sound output holes 2 are close to ear canals, so that it will not compress the ears and ear canals, and is more comfortable to use. 3. The flexible belt body 1 adopts a silicone belt body or a rubber belt body, and the surface of the headset bodies 4 that is in contact with human body is provided with a glue layer 3, which has the anti-slip and waterproof function, which can more effectively prevent the headset from falling off due to vibration and sweat during exercise. 4. A multi-section belt body is adopted to embody the connection between the headset body 4 and the flexible belt body 1 through the cooperation of the hole array 19 and the needle array 21, which has the characteristics of convenient production and facilitates the miniaturization of the headset body 4. 5. The special microphone installation structure can effectively prevent water from entering the headset body 4 through the sound input hole 15. 6. The Bluetooth module and the battery are installed in the two headset bodies 4, which facilitates miniaturization of the headset body 4.

The above detailed description of the present disclosure is given through specific embodiments. These detailed descriptions are only limited to helping those skilled in the art understand the content of the present disclosure, and should not be understood as limiting the scope of protection of the present disclosure. Various modifications, equivalent transformations, etc. performed by those skilled in the art under the concept of the present disclosure should be included in the protection scope of the present disclosure.

What is claimed is:

1. A flat headset, comprising:

a flexible belt body configured to be looped around a head; and two headset bodies fixed to the flexible belt body, wherein, the headset bodies have flat structure, and at least parts of the headset bodies protrude from one edge of the flexible belt body and are provided with sound output holes on a side away from the flexible belt body, wherein when the flexible belt body is fixed to the head, the two headset bodies are held on front upper sides of two ears, and the sound output holes are close to ear canals, and wherein a glue layer is provided on a surface of the headset bodies which is in contact with human body.

2. The flat headset according to claim 1, wherein the flexible belt body is a silicone belt body, a rubber belt body, a polyurethane belt body or a thermoplastic elastomer belt body.

3. The flat headset according to claim 2, wherein the rubber belt body is a thermoplastic rubber belt body and the polyurethane belt body is a thermoplastic polyurethane belt body.

4. The flat headset according to claim 1, wherein the flexible belt body comprises a connecting buckle with adjustable elasticity.

5. The flat headset according to claim 1, wherein the flexible belt body is composed of three sections, a hole array is provided on an end of each section, a needle array corresponding to the hole array is provided on the headset body, the hole array and the corresponding needle array are configured to integrate the headset bodies and the three sections of the flexible belt body into one piece.

6. The flat headset according to claim 5, wherein a connecting groove is provided on the end of each section, and an edge of the headset body is snap-fitted with the connecting groove.

7. The flat headset according to claim 1, wherein a receiving cavity corresponding to a microphone on a circuit board is provided inside the headset body, a sound input hole communicating with the receiving cavity is provided on the protruding part of the headset body, and a sealing pad is provided between a mouth of the receiving cavity and the circuit board.

8. The flat headset according to claim 1, wherein a light exit hole corresponding to an indicator light on a circuit board is provided on a face shell of the headset body, and a sealing pad is further arranged between a periphery of the indicator light and the face shell.

9. The flat headset according to claim 1, further comprising a wireless connection module and a battery, wherein the wireless connection module is installed in one of the headset bodies, and the battery is installed in the other one of headset bodies.

10. The flat headset according to claim 1, wherein a face and a back of the headset bodies are both long strips and edges of the face and the back adopt arc transition.

* * * * *